US007210179B2

(12) United States Patent
Kidwell

(10) Patent No.: US 7,210,179 B2
(45) Date of Patent: May 1, 2007

(54) CONTOURED BODY SUPPORT DEVICE

(76) Inventor: Donald E. Kidwell, 6965 Olive Damsel Ct., Hughesville, MD (US) 20637

( * ) Notice: Subject to any disclaimer, the term of this patent is extended or adjusted under 35 U.S.C. 154(b) by 0 days.

(21) Appl. No.: 11/376,562

(22) Filed: Mar. 16, 2006

(65) Prior Publication Data

US 2006/0288486 A1 Dec. 28, 2006

Related U.S. Application Data

(60) Provisional application No. 60/661,904, filed on Mar. 16, 2005.

(51) Int. Cl.
*A47G 9/00* (2006.01)
*A47D 20/02* (2006.01)
*A47D 20/08* (2006.01)

(52) U.S. Cl. ..... 5/656; 5/639; 5/632; 5/633

(58) Field of Classification Search ..... 5/656, 5/639, 632, 630, 652, 645, 633, 653; 190/1, 190/2; 383/110; 62/457.7; 220/495.06
See application file for complete search history.

(56) References Cited

U.S. PATENT DOCUMENTS 2,509,537 A * 5/1950 Stier ..... 220/9.1
3,263,246 A * 8/1966 Towery ..... 5/639
3,323,151 A 6/1967 Lerman
3,938,205 A 2/1976 Spann
4,222,468 A 9/1980 De Fries
4,233,700 A 11/1980 Spann
4,273,221 A * 6/1981 Poag ..... 190/8
4,535,495 A 8/1985 Oldfield
4,733,836 A * 3/1988 Barnes ..... 248/106
5,081,727 A * 1/1992 Ippolito ..... 5/419
5,224,226 A 7/1993 Groenwald
5,269,323 A 12/1993 Krouskop
5,348,523 A 9/1994 Blount
5,396,674 A 3/1995 Bolds
5,435,025 A * 7/1995 Gerard et al. ..... 5/419
5,515,564 A * 5/1996 Lyons ..... 5/639
5,806,118 A * 9/1998 Lerner ..... 5/639
5,906,018 A 5/1999 Kidwell

* cited by examiner

*Primary Examiner*—Alexander Grosz
(74) *Attorney, Agent, or Firm*—Edell, Shapiro & Finnan, LLC

(57) ABSTRACT

A body support device includes a base section with a wall ergonomically contoured to conform generally to the portion of the human back between the head and lower torso as it reclines in a posture intermediate prone and supine positions. The contoured wall further supports a user in seated and supine positions. The base may also include a cavity disposed at the end of the base that receives an object. A cap connects to the base to cover the cavity and secure the object therein. In addition, a connecting member may be used to connect multiple support devices together at a desired angle. A protective cover may also be used to prevent damage to the body support device.

15 Claims, 8 Drawing Sheets

CONTOURED BODY SUPPORT DEVICE

CROSS REFERENCE TO RELATED APPLICATIONS

This application claims priority to U.S. Provisional Application 60/661,904 filed 16 Mar. 2005 and entitled "Improved Body Support for Sun Tanning", the disclosure of which is incorporated herein by reference in its entirety.

FIELD OF THE INVENTION

The present invention relates to a body support device and, in particular, to a system of interconnecting, contoured body supports including removable end caps.

BACKGROUND OF THE INVENTION

Sunbathing is a means to acquire a robust healthy appearance, to socialize and to enhance production of vitamin D. To those seriously searching for the "perfect tan" as well as casual dabblers in the past-time, an annoying and persistent problem has been the difficulty in finding an even moderately comfortable position to expose side surfaces of the body, arms and legs to direct rays of the sun. Conventional beach chairs, along with lacking storage capability, do not have sufficient surface area to avoid sinking into soft support surfaces such as sand. Consequently, a need exists to provide a portable body support device that comfortably supports a user while providing easily accessible storage.

One approach to this problem is disclosed in U.S. Pat. No. 5,906,018 (Kidwell), the contents of which are incorporated herein by reference in their entirety. Kidwell shows a body support including a central storage compartment. This approach is adequate in many ways, but suffers from several disadvantages. First, the compartment has limited storage capacity. Due to its location proximate the inward curve of the curved surface, the permissible height and depth of the interior space is restricted. There is, moreover, a limit on the amount of interior space that can be provided due to structural support concerns (i.e., preventing the unit from collapsing under the weight of a user). The larger the storage compartment becomes, the more susceptible the body support is to collapse. Second, the body support, in order to provide a user easy access to the storage compartment, must be set on a supporting surface such that the storage compartment is exposed. Third, due to its closed-ended structure, the body is only capable of individual use, and cannot be connected to other body supports to create a system of supports.

SUMMARY OF THE INVENTION

In accordance with this invention, a body support device is disclosed. The body support device includes a base section having a first terminal end and a second terminal end. The base may have a wedge-shaped structure formed via three walls. Two walls may have generally planar surfaces, while the third wall may be ergonomically contoured to conform generally to the portion of the human back between the head and lower torso reclining in a posture intermediate the prone and supine positions. The contoured surface may further support a user in seated and supine positions. The base may further include a cavity formed in one or both of its ends. A removable cap is provided selectively secure the cavity closed, permitting the storage and/or transport of an object therein. Alternatively, a connecting member may couple a plurality of support devices together, providing a network of support devices suitable for concurrent use by a group of people.

BRIEF DESCRIPTION OF THE DRAWINGS

Like reference numerals have been used to identify like elements throughout this disclosure.

DESCRIPTION OF THE PREFERRED EMBODIMENTS

Figure 1A:
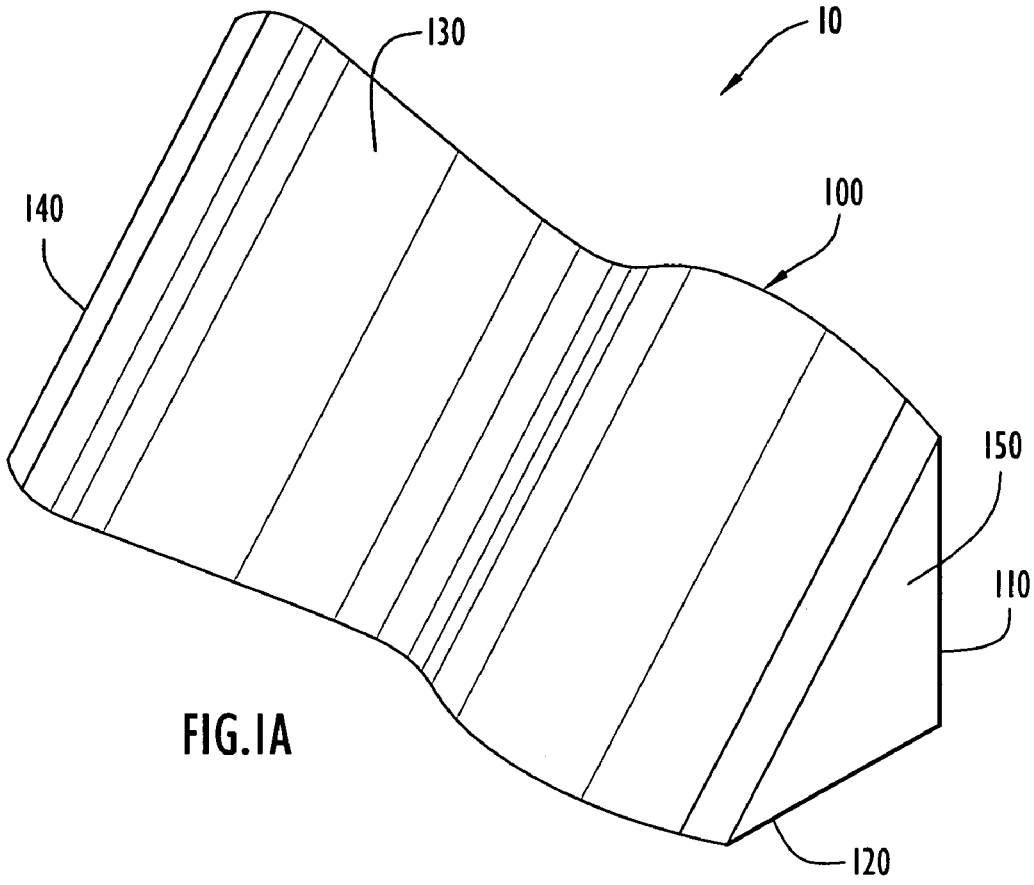
FIGS. 1A and 1B illustrate front and rear perspective views, respectively, of a body support device according to an embodiment of the present invention.
Figure 1B:
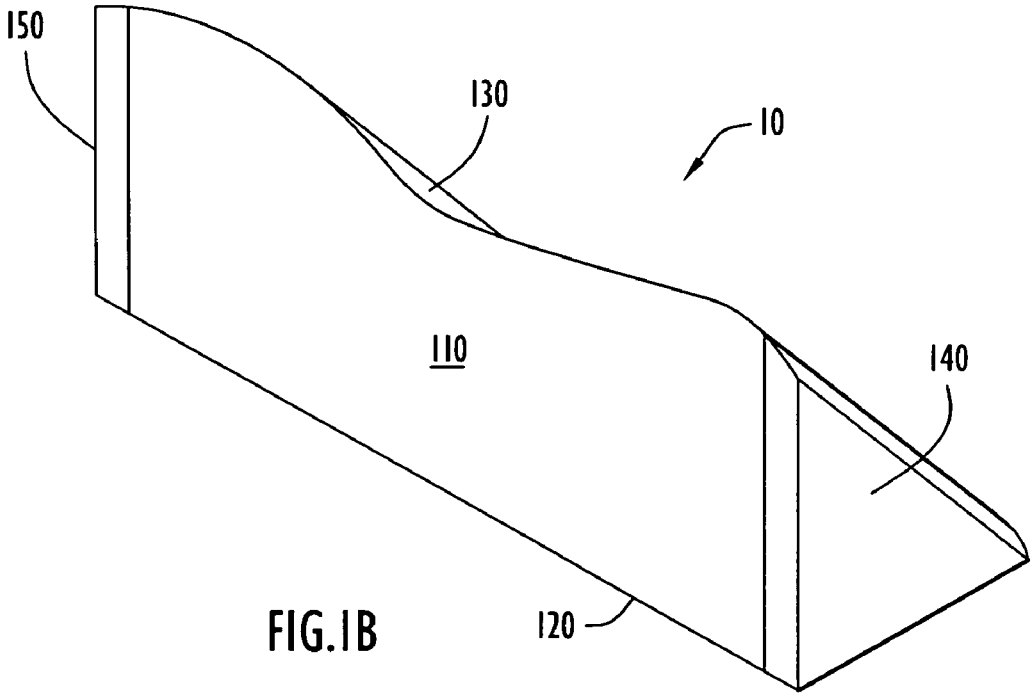

The body support device according to the present invention comprises a structure configured to provide a portable back and side rest for a user (e.g., a sunbather). FIGS. 1A and 1B illustrate a body support device 10 according to an embodiment of the invention. As illustrated, the body support device 10 may comprise a base 100 including a first wall 110 forming a perpendicular abutment with the second wall 120. The first wall 110 and the second wall 120 are typically configured to engage a supporting surface (e.g., the ground, a bed, grass, beach sand, sidewalks, floors, pavement, etc); consequently, each of the first and second walls 110, 120 may possess a substantially planar surface. In embodiment illustrated, the first wall 110 is generally vertical, while the second wall 120 is generally horizontal.

The base 100 further includes a third wall 130 extending from the first wall 110 to the second wall 120 to form a generally wedge-shaped, elongated structure. For example, the contoured surface (i.e., the third wall 130) may extend from the first wall 110 to the second wall 120 such that it forms approximately 45° angles with the first and second walls 110, 120. It is important to note, however, that the slant or angle assumed by the third wall 130 can be varied to values greater or less than 45°, generally between about 30° and 60°, to suit conditions and personal comfort. The third wall 130 is configured to support (engage the body of) a user; consequently, the surface of the third wall 130 is ergonomically contoured to provide comfortable support to the back and sides of a user assuming a posture between the prone and supine positions, particularly the sides of the body and limbs. This provides a more comfortable sitting/lying position for reading, lounging, etc., as well as (with regard to sunbathers) allows better orientation with respect to the sun of these typically difficult to tan body portions. Referring to FIG. 1A, the surface of the third wall 130 undulates, including expanded and narrowed sections. The expanded sections may be enlarged in both width and depth with respect to the narrowed sections. The surface of the third wall 130, then, includes sequentially adjacent portions dimensioned to conform to the head, neck, back, waist and buttocks of the body.

With this configuration, the third wall 130 may engage the portion of the body extending from the head to the lower body or buttocks of the user (when a user lies on the body support device 10 such that the user is generally parallel thereto). Alternatively, a user may be supported by the body support device 10 in a seated position (where the user is positioned generally transverse with respect to the body support device 10). In other words, the support device 10 is operable to support a user in any one of the seated position, the supine position, and a position intermediate of the prone and supine positions. Further details regarding the general structure of the base 100 and its contoured surface are disclosed in U.S. Pat. No. 5,906,018, incorporated by reference in its entirety above.

The base 100 may further include a first end 140 and a second end 150. As illustrated in FIGS. 1A and 1B, the ends 140, 150 may form generally parallel, isosceles right triangles. The ends 140, 150 may have the same or different dimensions. Typically, to accommodate the contoured surface of the third wall 130, the cross sectional dimensions of the base 100 proximate the first end 140 is greater than the cross sectional dimension of the base 100 proximate the second end 150.

Figure 2:
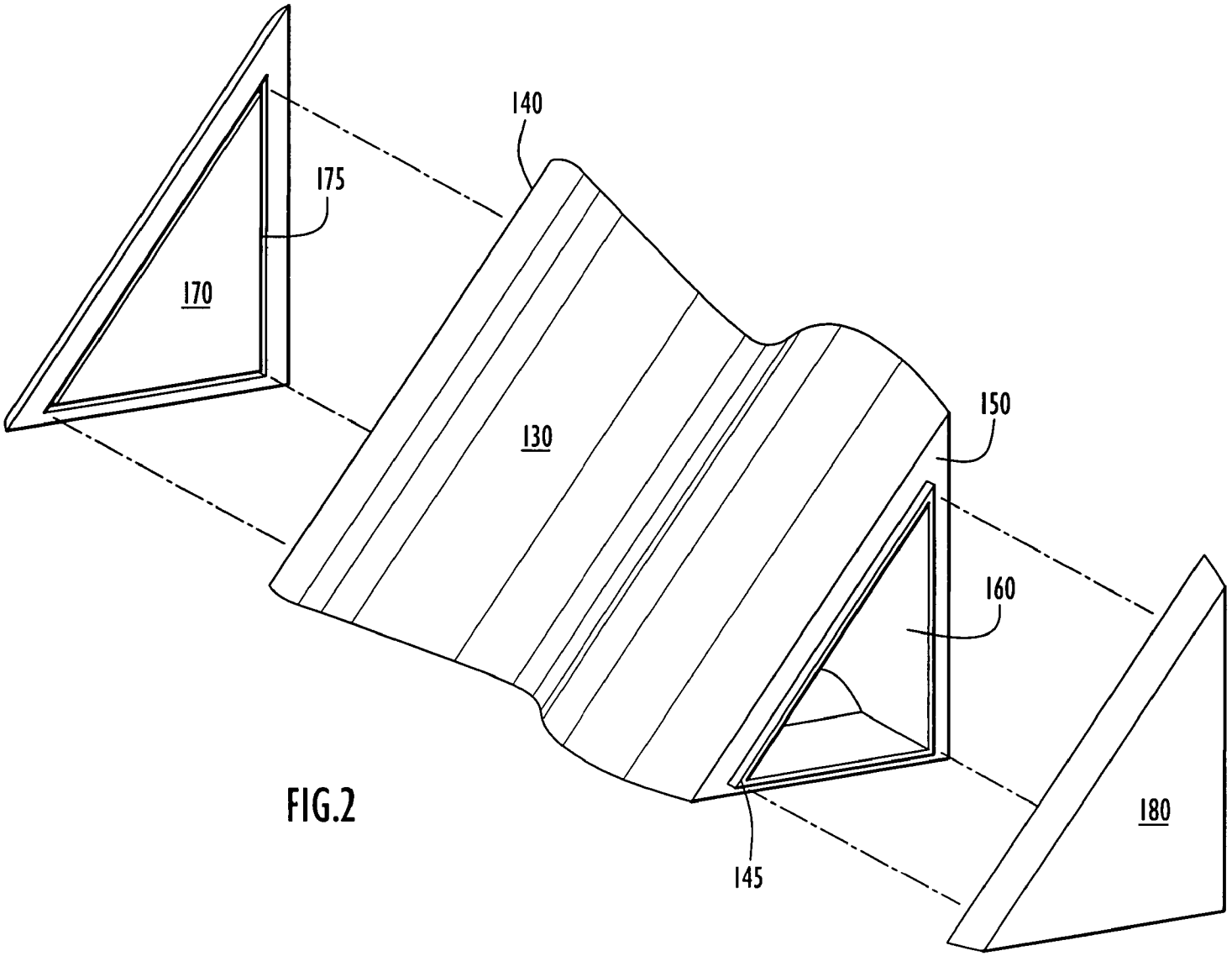
FIG. 2 illustrates a front exploded view of the body support device of FIGS. 1A and 1B, showing caps connecting to the base.
Figure 3:
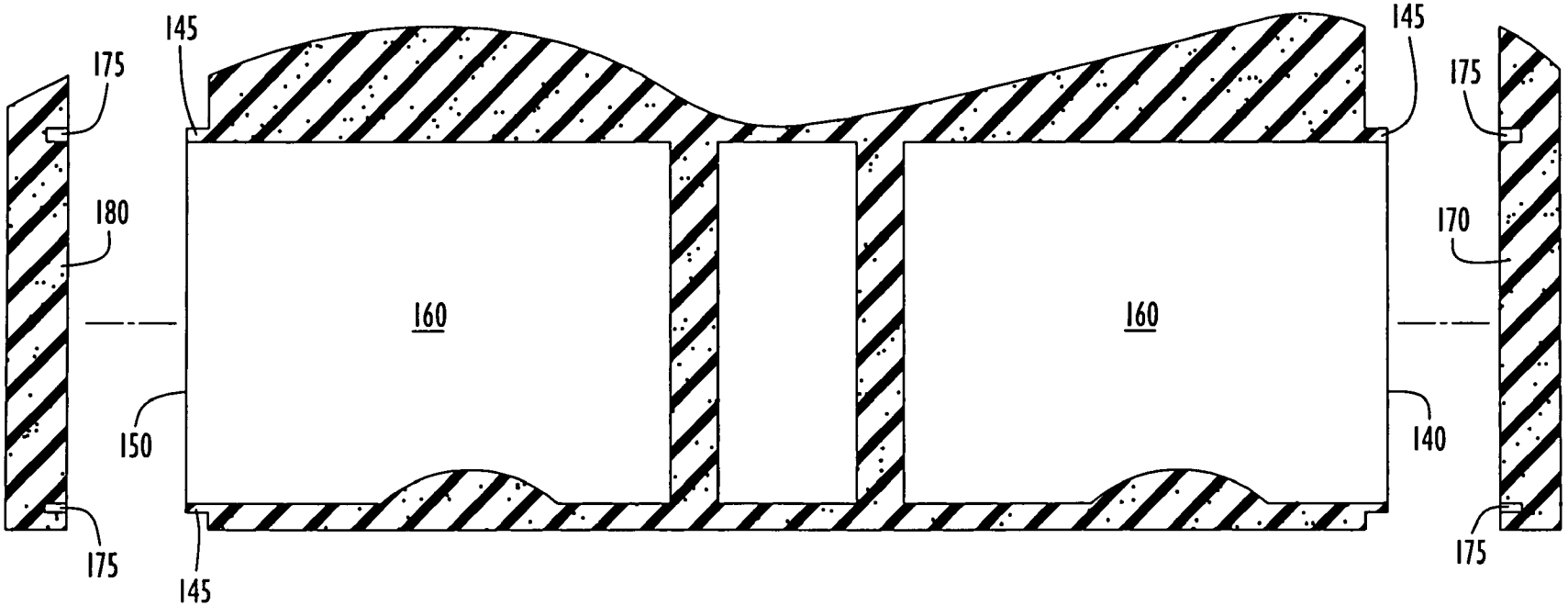
FIG. 3 is a rear, cross-sectional view the body support device of FIGS. 1A and 1B, showing the storage cavities.

Referring to FIGS. 2 and 3, the body support device 10 may be configured to receive an object for storage and/or transport. As illustrated, the base 100 may be generally hollow, notwithstanding that one or more reinforcing supports may disposed throughout the structure. Each end 140, 150 of the base 100 may include a receptacle 160 defined therein. The receptacle 160 may comprise any size and shape suitable for its described purposed. For example, each receptacle 160 may be sized to provide storage for such items as suntan lotion, towels, reading material, beverages, and other personal items. A first cap 170 connects to the first base end 140 to secure the contents of the receptacle 160 within the base 100. Similarly, a second cap 180 connects to the second base end 150. Once connected, a secure, generally fluid tight seal is formed. The manner of connection is not particularly limited. As best seen in FIGS. 2 and 3, the interior side (the side that faces the base 100) of each cap 170, 180 includes a slot or groove 175 configured to mate with a rib or tab 145 extending from the each base end 140, 150. The groove 175 may extend completely or partially around the end cap 140, 150, and may extend proximate the cap's periphery. The tab 145 frictionally engages the groove 175, securing the cap 170, 180 to the body 100. It is to be understood, however, that other methods that provide releasable engagement of the cap 170, 180 with the body (e.g., fasteners) may be utilized.

The body support device 10 (the body 100 and/or the caps 170, 180) may be formed from any material suitable for its described function. By way of example, the body support device 10 may be formed from a generally rigid material such as plastic, fiberglass, wood, metal, etc. In preferred embodiment, the body support device 10 is formed from molded resin and, specifically of moldable foam resin made from a copolymer of polystyrene and polyethylene (sold under the trade name ARCEL, manufactured by the Nova Chemical Company, Moon Township, Pa. (www.novachem-.com)). Forming the body support device 10 from molded foam resins provides a support device that is sufficiently rigid to support the user, while being light weight for easy transport. In addition, the insulating properties of the resin enables the receptacles to function as an insulated beverage cooler. Furthermore, the material is sufficiently buoyant, making the body support device 10 suitable for use in recreational water activities (e.g., the support device 10 may be used as a flotation device). Alternatively, any sufficiently strong lightweight material may be utilized.

In operation, a user (e.g., a sunbather) loads his or her desired sunbathing accoutrements into a receptacle 160, secures the cap 170, 180 and transports the body support device 10 to a selected site (beach, campground, pool, etc.). The various required notions are removed for handy access and the body support device 10 is placed such that the second wall 120 contacts the supporting surface. Alternatively, the body support device 10 may be placed such that the first wall 110 contacts the supporting surface. With either configuration, body support device 10 may be aligned with the elongate axis generally perpendicular to the path of the sun and with the third wall 130 directed roughly toward the source of radiation. The user then assumes a comfortable posture intermediate prone and supine with a first side of his or her head, neck, back, small of the back or waist and lower torso or buttocks resting against the corresponding portions of the support and the opposite sides exposed to the direct tanning rays. Periodic reversals of the radiated side ultimately produce the desired even tan, equally distributed over all the desired body surfaces. Alternatively, should a user prefer to rest in a seated position, the user leans against the third wall 130 in a direction generally perpendicular to the body support device 10, such that the lower/middle portion of the back is positioned within the desired curvature of the support surface. Furthermore, should the supine position be desired, a user may selectively rest his head along any portion of the third wall 130.

Figure 4A:
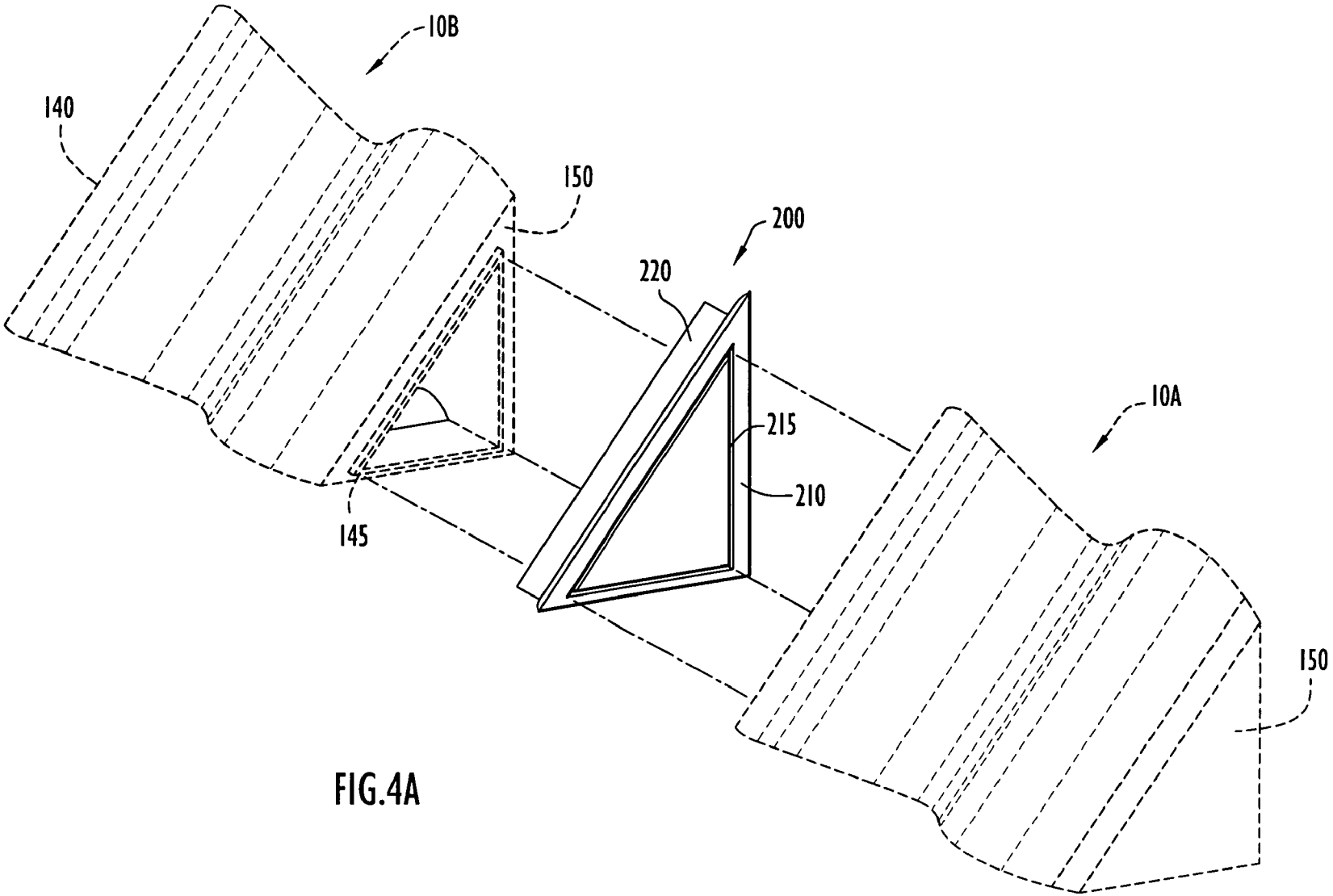
FIG. 4A is a perspective view of a connection member for connecting a plurality of body support devices together according to an embodiment of the invention.
Figure 4B:
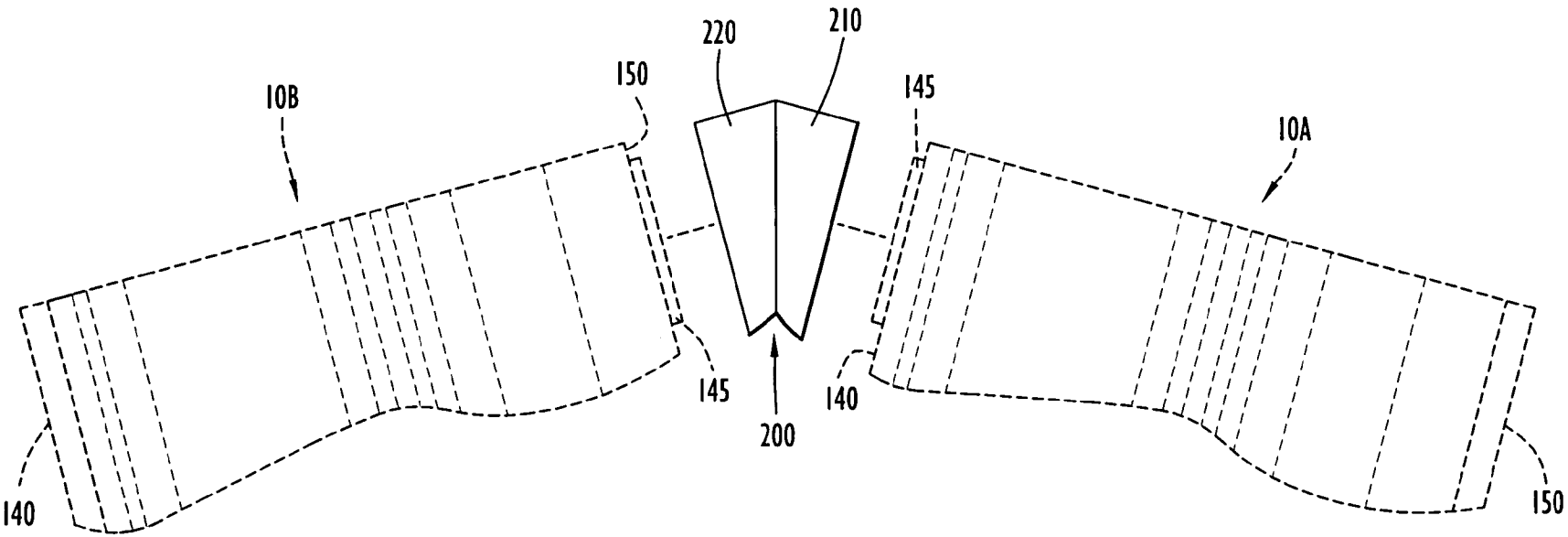
FIG. 4B is a top perspective view of a connection member for connecting a plurality of body support devices together according to another embodiment of the invention.

The body support device 10 may further be part of a network or system of body support devices 10 releasably connected to each other via a connection member 200. FIGS. 4A and 4B illustrate connection members operable to couple two support devices 10A, 10B to each other. As shown, the connection member 200 may have a configuration similar to that of the caps 170, 180, forming an isosceles right triangle. The connection member 200 may include a first portion 210 formed with a slot or groove 215 configured to engage the rib or tab 145 (not illustrated) located along the first end 140 of a body support device 10, and a second portion 220 formed with a slot or groove (not illustrated) configured to engage the rib or tab 145 located on the second end 140 of the body support device 10. The first portion 210 may have dimensions similar to or different from those of the second portion 220. By way of the example, the first portion 210 may have dimensions slightly larger than those of the second portion 220 to accommodate for the size differential that exists between the first and second ends 140, 150 (discussed above).

In operation, a first body support device 10A is aligned with the groove 210 of the first connection member portion 210. The tab 145 located on the first end 140 of the body support device 10 is inserted into the groove 215, coupling the connection member 200 to the first body support device 10A. Similarly, a second body support device 10B is aligned with the second portion 220 of the connection member 200, and the rib 145 (extending from the surface of the second end 150) is inserted into the groove of the second portion 220 (not illustrated). The grooves mate with the ribs 145 to provide a secure connection of multiple body support devices 10, orienting the first support device 10A at an angle of approximately 180° with respect to the second support device 10B.

In addition, the connection member 200 may be modified to orient the first body support device 10A with respect to the second body support device 10B at angles other than 180°. Referring FIG. 4B, the first portion 210 of the connection member 200 may be canted with respect to the second portion 220. The degree of canting is not particularly limited, and includes angles of approximately 90° to approximately 180°. Although only two body support devices 10A, 10B are illustrated in embodiment of FIG. 4, a plurality of connection members 200 may be provided to secure a plurality of body support devices 10 together. As a result, the canted connection member 200 may further be utilized to provide a plurality of body support devices 10 connected in a generally curved pattern. By way of example, the connection members 200 may be utilized to create a network of coupled body support devices 10 configured in any desired formation, e.g., in a half or full circle.

Figure 5A:
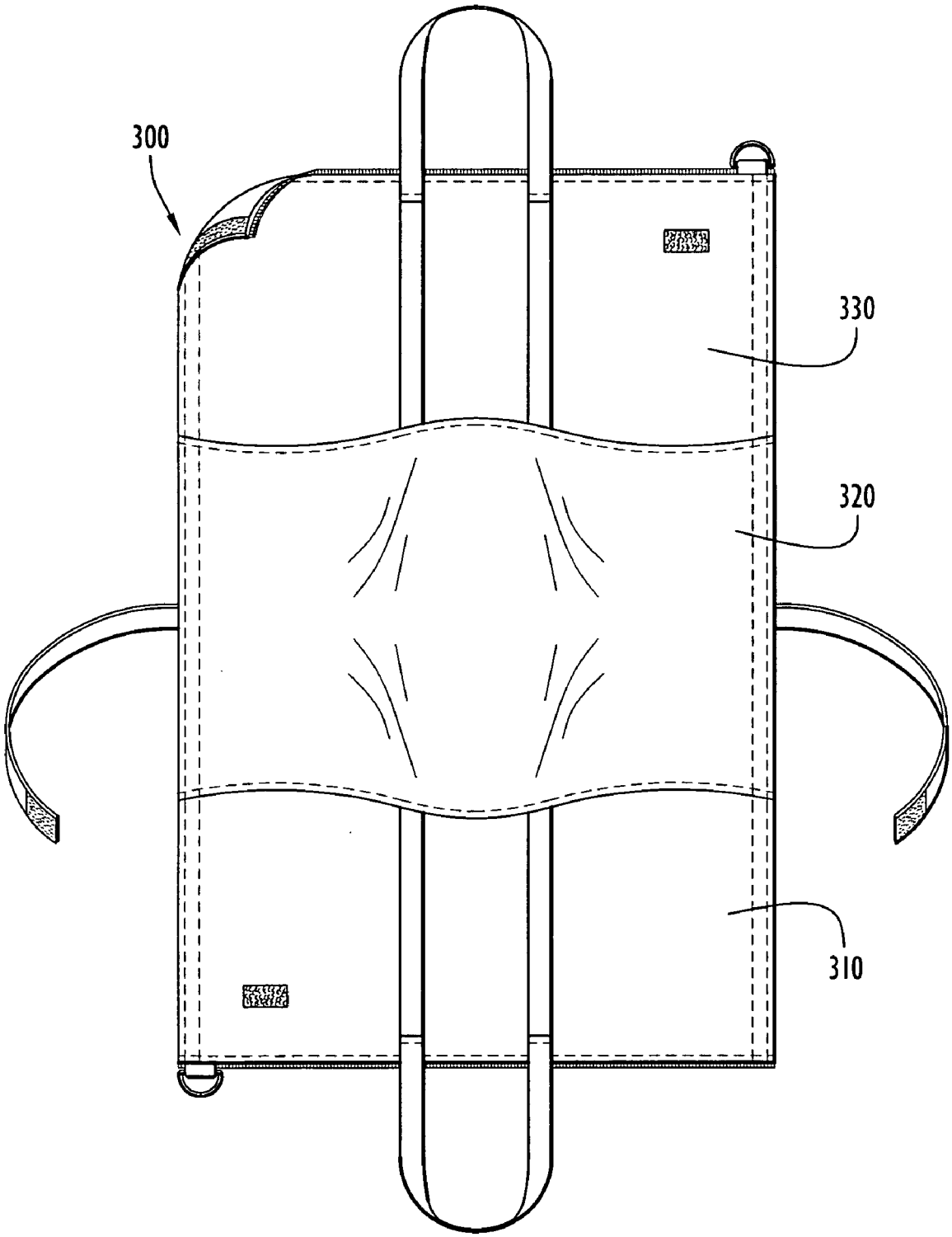
FIGS. 5A and 5B are top plan views of protective enclosures for the body support device of FIGS. 1A and 1B.
Figure 5B:
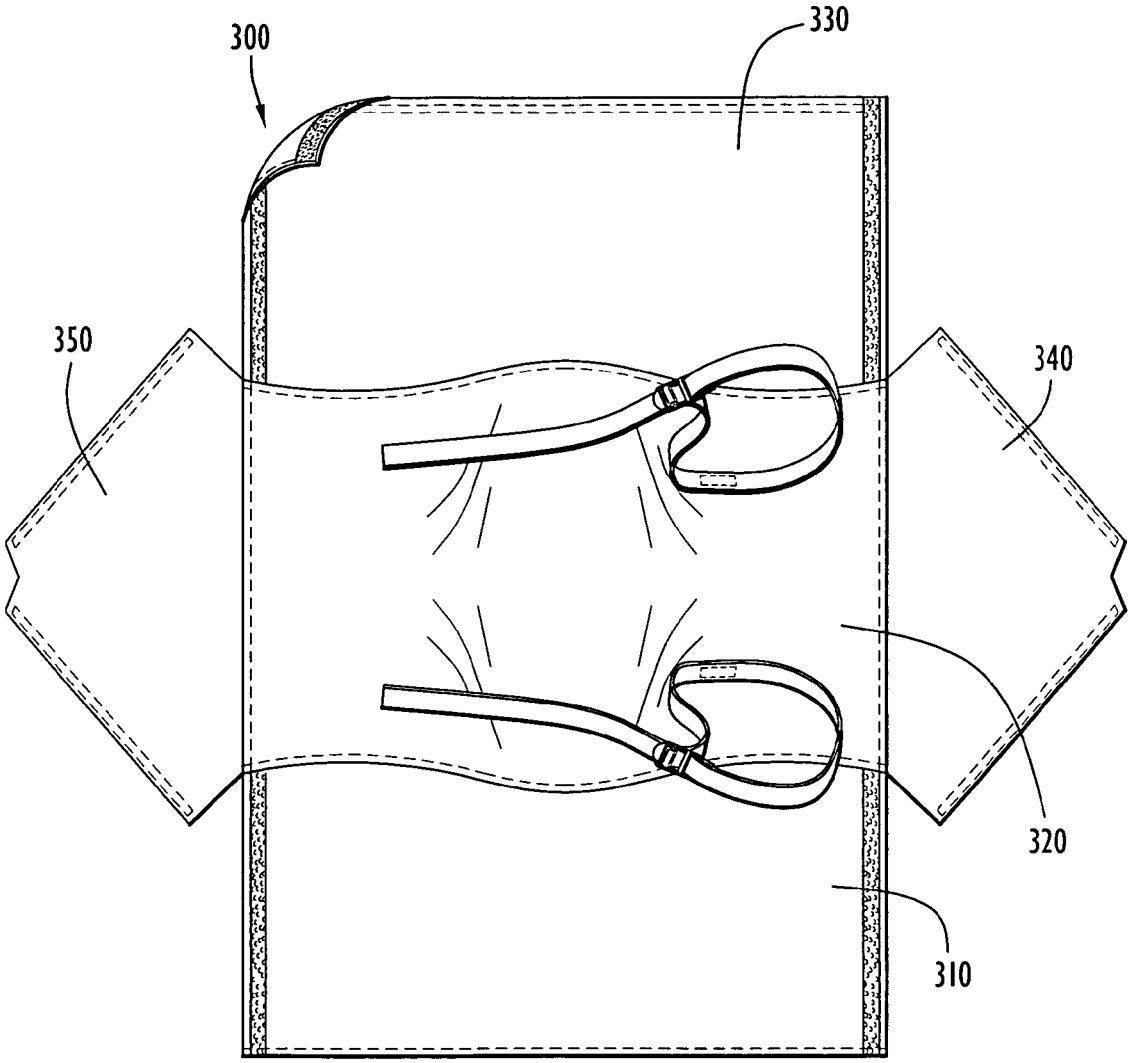

A protective enclosure may further be provided to prevent damage to the body support device 10 and/or to provide a desired amount of cushioning thereto. FIGS. 5A, 5B are isolated views of a protective enclosure 300 according to embodiments of the invention. As illustrated, the enclosure 300 includes a first section 310, a second section 320, and a third section 330. The first section 310 is configured to cover the first wall 110 of the base 100 and the third section 330 is configured to cover the second wall 120 of the base 100. The second section 320 includes a shape that corresponds to the undulating surface (i.e., the contours) of the third wall 130. Referring specifically to FIG. 5B, the enclosure 300 may further include end sections 340, 350 operable to cover the first end 140 and second end 150 of the base 100, respectively.

Figure 6:
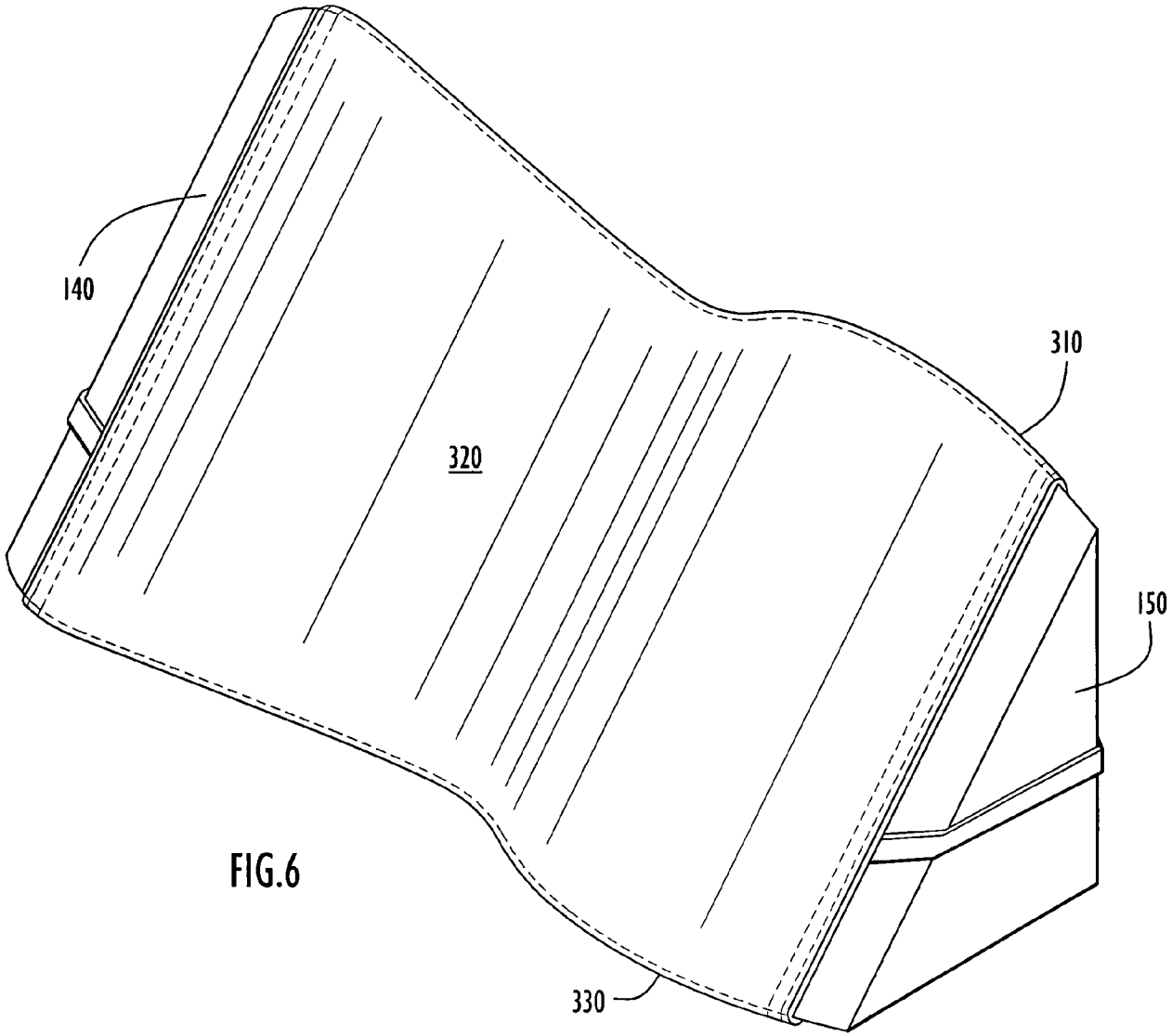
FIG. 6 illustrates a body support device covered with the protective enclosure of FIG. 5A.

With this configuration, when the enclosure 300 is placed over the base 100, the enclosure 300 is generally form fit onto the base 100 (i.e., the enclosure 300 is taut on the body support device 10). FIG. 6 illustrates the enclosure of 5A secured to the body support device 10. In operation, the first section 310 of the enclosure 300 is aligned with the first wall 110 of the base 100. Similarly, the second enclosure section 310 is aligned with the third base wall 130 and the third enclosure section 330 is aligned with the second base wall 120. The enclosure 300 is then placed over the base 100, with the first section 310 of the enclosure 300 secured to the third section 330 of the enclosure 300 in a conventional manner (e.g., via straps). Additionally, if the enclosure 300 includes end sections 340, 350, they are folded over their respective end 140, 150 of the base 100 and secured to the appropriate portions of the enclosure 300.

Although straps are illustrated in the embodiment of FIG. 6, it should be understood that the sections 310, 320, 330, 340, 350 of the enclosure 300 may be secured using conventional fastening devices, including permanent (e.g., adhesive, stitching) and releasable (e.g., straps, hook and loop fasteners, snaps, buttons, hooks, etc.) fasteners. The enclosure may include multiple sections, or may comprise a unitary structure. In addition, the enclosure 300 may be secured to the body support device 10 utilizing thermal wrapping techniques.

The material forming the enclosure 300 may be formed from any material suitable for its described function. For example, the enclosure 300 may comprise woven and non-woven webs, and may be formed from natural and synthetic materials. By way of further example, the sections 310, 320, 330, 340, 350 of the cover 300 may individually or collectively comprise cotton (terry cloth), canvas, spandex, vinyl, polypropylene, etc. The materials utilized may be chosen based on the particular application of the body support device 10. For example, when the body support device 100 is to be utilized as a beach support for tanning, the first 310 and third 330 sections of the enclosure 300 (the sections corresponding to the first and third walls 110, 120 of the base 100 that engage the supporting surface) may comprise a durable, water resistant material such as canvas. The second section 320, which contacts the user, may comprise a soft, water absorbent material such as cotton. Alternatively, when used in a more rugged environment, the entire enclosure 300 may comprise durable material such as canvas. If additional cushioning is desired, the surface of the enclosure 300 may be lined with padding (e.g., foam padding).

While the invention has been described in detail and with reference to specific embodiments thereof, it will be apparent to one skilled in the art that various changes and modifications can be made therein without departing from the spirit and scope thereof. For example, the body support device 10 may be any size and shape suitable for its described purpose. The cross-section of the body support device 10 need not be specifically triangular, rather, any sufficiently strong yet lightweight structure having at least one surface inclined with respect to the foundation and contoured to provide uniform body support would fall within the scope of this invention. The cavities 160, in addition to storing devices, may have electronic devices such as radios, TVs, etc. embedded therein. Thus, it is intended that the present invention covers the modifications and variations of this invention that come within the scope of the appended claims and their equivalents.

I claim:

1. A generally rigid body support device comprising:

a generally hollow wedge-shaped base including:

a first end and a second end, a first substantially planar wall, a second substantially planar wall, and a third wall including a contoured surface configured to engage a body, wherein the contours of the third base wall surface comprise sequentially adjacent portions dimensioned to conform to the head, neck, back, waist and buttocks of the body;

a first cavity operable to store an item formed in the first end; and a first cap configured to couple to the first end, wherein the body support device is capable of supporting a user in a seated position, a supine position, and a position intermediate of the prone and supine positions.

2. The body support device of claim 1, wherein the third wall forms angles of approximately 45° with the first wall and the second wall.

3. The body support device of claim 1, wherein the base further includes:

a second cavity operable to store an item formed in the second end; and a second cap configured to couple to the second end.

4. The body support device of claim 3, wherein each of the first cavity and the second cavity extend partially into the base.

5. The body support device of claim 1, further including a form-fitting enclosure adapted to removably connect to the base.

6. The body support device of claim 5, wherein the enclosure further comprises a layer of cushioning oriented such that the cushioning extends along the third wall of the base.

7. The body support device of claim 1, wherein the base is formed from material selected from the group consisting of plastic, fiberglass, and moldable foam resin.

8. The body support device of claim 1, wherein:

the first wall is adapted to rest on a supporting surface; and the second wall extends upward from the supporting surface and abuts the first wall along a common edge of the first and second walls.

9. The body support device of claim 8, wherein the third wall is inclined at an angle in the range of approximately 30° to 60° with respect to the supporting surface.

10. The body support device of claim 1, further comprising a cover disposed over at least a portion of the body support device.

11. The body support device of claim 10, wherein the cover comprises:

a first portion configured to cover the first wall;

a second portion configured to cover the second wall; and a third portion configured to cover the third wall.

12. The body support device of claim 11, wherein the enclosure further comprises a fourth portion configured to cover the first end; and a fifth portion configured to cover the second end.

13. The body support device of claim 12, wherein the enclosure further comprises indicia disposed at least one of the cover portions.

14. The body support device of claim 10, wherein the cover is formed from material selected from the group consisting of canvas, cotton, polypropylene, and vinyl.

15. The body support device of claim 1, further comprising a connector operable to releasably couple one of the ends of the body support device to an end of another body support device.

* * * * *